US006444413B1

(12) United States Patent
Uto

(10) Patent No.: US 6,444,413 B1
(45) Date of Patent: Sep. 3, 2002

(54) PHOTOGRAPH BACKING METHOD, BACKING MATERIAL AND ITS BONDING APPARATUS

(76) Inventor: Mitsutaka Uto, 22-19, Funai 2-chome, Iwatsuki-shi, Saitama (JP)

( * ) Notice: Subject to any disclaimer, the term of this patent is extended or adjusted under 35 U.S.C. 154(b) by 0 days.

(21) Appl. No.: 09/662,449

(22) Filed: Sep. 14, 2000

(30) Foreign Application Priority Data

Sep. 16, 2000 (JP) ..... 11-262169

(51) Int. Cl.[7] ..... G03C 11/14

(52) U.S. Cl. ..... 430/432; 430/11; 430/12; 430/939; 40/702; 40/773

(58) Field of Search ..... 430/432, 11, 12, 430/939; 40/702, 773

(56) References Cited

U.S. PATENT DOCUMENTS 1,858,405 A * 5/1932 MacLaurin ..... 40/773
2,400,365 A * 5/1946 Murray ..... 430/11
3,386,199 A * 6/1968 Nagatsuka ..... 40/773
3,581,423 A * 6/1971 Mascolo ..... 40/773
3,670,434 A * 6/1972 Shibita et al. ..... 40/773
3,736,685 A * 6/1973 Shibita et al. ..... 40/773
3,857,192 A * 12/1974 Mascolo ..... 40/773
3,994,088 A * 11/1976 Ohfuji ..... 40/773

* cited by examiner

*Primary Examiner*—Richard L. Schilling
(74) *Attorney, Agent, or Firm*—Schmeiser, Olsen & Watts

(57) ABSTRACT

A backing material (1) is resistant to variations in heat, temperature and in moisture. Further, the backing material (1) is large in bending strength, tearing strength and in resiliency. Still further, the backing material (1) is relatively thin in thickness and light in weight, is tough, and is under tension so as to be resistant to curling and warping deformation. A worker may cut the backing material using ordinary scissors, knives and like ordinary cutting tools. Even an amateur worker may easily treat the backing material in a mirror-finishing operation of a photograph. Disposed on a photograph bonding surface of the backing material (1) are an immense number of deposits of an adhesive (2). These deposits assume dot-like shapes or linear shapes, and are provided at appropriate intervals. Alternatively, the photograph bonding surface is dense with geometrical microscopic irregularities or microscopic through-holes being filled with an adhesive. A photograph (3) is bonded to the photograph bonding surface of the backing material (1).

10 Claims, 11 Drawing Sheets

PHOTOGRAPH BACKING METHOD, BACKING MATERIAL AND ITS BONDING APPARATUS

BACKGROUND OF THE INVENTION

1. Field of the Invention

The present invention relates to a method of backing a photograph, a backing material for backing the photograph, and an apparatus for bonding the backing material to the photograph. More particularly, the present invention relates to a method of backing a photograph, a backing material for backing the photograph, and an apparatus for bonding the backing material to the photograph, through which the present invention enables a user to fit a photograph into a frame for its display in a condition in which the photograph enables its mirror-finished surface to be smooth, i.e., free from any deformation such as geometrical irregularities, warping, feature or waving and like deformations.

2. Description of the Related Art

Although a surface of a photograph is originally flat, there is a fear that the photograph is impaired its appearance as a whole when the photograph uses as its base a plastics substrate instead of a paper substrate. More specifically, due to a difference in appearance in finished surface of an emulsion layer of the photograph between the plastics-substrate photograph and the paper-substrate photograph, the former (i.e., plastics-substrate photograph) is impaired its appearance as a whole even when the surface of the plastics-substrate photograph includes minor geometrical irregularities. This is because the surface of the plastics-substrate photograph is mirror-finished, which makes it possible to accumulate much attention on such geometrical irregularities. Consequently, it is very important for the plastics-substrate photograph to keep its mirror-finished surface in good condition.

In the photograph or work intended for display use, ornamentation use or the like, there is a fear that the work deteriorates its value under the influence of heat radiated from a spot light and the like. This is because the heat increases a surface temperature of the work, and is then transmitted to a backing material of the work to wave or distort the same so that the work loses its smoothness in its display surface.

In order to avoid such trouble, it is so devised that the backing material made of plastics such as vinyl chloride, acrylic resin and the like has its thickness increased up to approximately 2 to 4 mm. Alternatively, the plastics material (i.e., backing material) has its opposite surfaces fixed to aluminum sheets.

However, the number of photographs or works used in an ordinary photograph exhibition ranges from 30 to 50 pieces. Consequently, in case that all the works require their backing materials made of vinyl chloride each having a thickness of 2 mm, the total weight of such backing materials reaches approximately 20 to 34 Kg. This makes it very hard for a female transporter to transport on foot these works from a processing laboratory and the like. Further, in preserving, the works tend to be damaged due to their heavyweight. Such heavy weight also poses another problem lying in the structural strength of their preserving place. Further, since these works are large in thickness, they require a large space in preserving.

Although there is material (for example, such as polycarbonate and the like) which has been rendered resistant to heat by itself, such material is only resistant to heat or only hard to melt. In other words, for example, when a sheet made of such material having a thickness of approximately 0.5 mm is heated in a condition in which the sheet has its peripheral portion fixed, the sheet deforms or waves as is in the case of a sheet made of vinyl chloride. Consequently, at the present time, a vinyl chloride sheet which is cheaper in cost is widely used.

On the other hand, as for methods for applying an adhesive to the photograph backing material in order to bond the photograph to the backing material, there are conventional two methods: a first one, wherein a double-faced adhesive tape is used over the entire surface of the backing material; and, a second one, wherein deposits of an adhesive assuming dot-like shapes are disposed over the entire surface of the backing material, or an adhesive is applied to the entire surface of the backing material. In the first method using the double-faced adhesive tape, air bubbles or adhesive pools are often formed. Further, application of pressure by hands or by means of rollers often cause a layer of the adhesive of the tape to wave. Consequently, in the case of a hard photographic sheet, an immense number of geometrical irregularities are formed in the surface of the photograph, and not absorbed by the sheet, as shown in FIG. 17(A). Due to this, the photograph has its appearance deteriorated in contrast with the case of a soft photographic paper which is capable of absorbing any adhesive pools formed thereon. In the second method disposing the adhesive deposits over or applying the adhesive to the entire surface of the backing material, the photograph is put on the backing material, and then rubbed by hand or squeezed using a roller to bond the photograph to the backing material. In such a second method, when the adhesive is large in viscosity, it is hard for such adhesive to move evenly. This tends to produce geometrical irregularities in the surface of the photograph, as shown in FIG. 17(B). Further, the hand's rubbing operation performed in the surface of the photograph tends to damage the photograph's surface. Further, in the other operation using the squeezing roller in order to bond the photograph to the backing material, when dust settles on the surface of the squeezing roller, the photograph's surface tends to be damaged by such dust.

There are two types in the method of disposing the dot-like adhesive deposits. One of these two types in used in bonding a postcard and the like, wherein a soft adhesive is used; a paper substrate and a corresponding photograph thereof are pressed together using the roller in bonding them together. In this first type of the method, there is no fear that an adhesive pool is smashed to produce air bubbles. This makes it possible to bond the photograph over substantially the entire surface thereof, and therefore to provide a sufficient bonding strength. In this case, however, since the adhesive used here is soft and therefore poor in resiliency, the hard photograph is not suitable in bonding since the geometrical irregularities tend to be formed on the surface of the photograph and such formation of the irregularities damages the photograph in appearance, as shown in FIG. 18(A).

In the second type of the method, even an amateur worker may easily bond the photograph ranging from a quarter-cut size to an uncut size. In this case, in order to reduce the bonding strength of thephotograph, the spacing of the adhesive deposits is increased so that the number of the adhesive deposits is within a range of approximately 180 to approximately 200 per square inch. This makes it possible for the worker to peel and repair a poorly bonded photograph. As shown in FIG. 18(B), each of the adhesive deposits has a flat top portion with a small center projection. In this case, the flat top portion of the adhesive deposit is relatively wide in surface area to form a convex portion. Such convex portion appears in the surface of the hard photograph to damage the photograph in appearance.

On the other hand, in case that the backing material is provided with an adhesive surface covered with a peelable sheet of paper., the photograph is bonded to such backing material in a conventional method comprising the following steps (1) to (5):

(1) an end portion of the peelable sheet is slightly peeled off to expose a part of the adhesive surface of the backing material;

(2) the photograph is then put on the backing material, and aligned therewith in peripheral position. After that, the worker pushes an end portion of the photograph by his finger to bond the thus pushed end portion of the photograph to the part of the adhesive surf ace of the backing material having been exposed in the preceding step (1);

(3) the photograph is then rolled up and gathered up at the end portion thereof. After that, the peelable sheet is removed from the backing material;

(4) a round bar is then put on the photograph and rolled thereon to unwind the thus rolled-up photograph in a manner such that the unwound photograph is bonded to the adhesive surface of the backing material;

(5) lastly, a hand roller is used to slightly urge the surface of the photograph, thereby releasing trapped air from an interface between the photograph and its backing material.

The conventional method for bonding the photograph to the backing material is performed as described above. However, as is clear from the above, the conventional method requires cumbersome steps (2), (3) and (5), wherein: in the step (2), it is necessary to expose the part of the adhesive surface of the backing material and also necessary to align the photograph in position with the backing material; in the step (3), it is necessary to roll up the photograph and to remove the peelable sheet from the backing material; and, in the step (5), it is necessary to release the trapped air from the interface between the photograph and the backing material. Due to the presence of such cumbersome operations, an unskilled worker tends to fail in releasing the trapped air. Further, in the conventional method, when dust settles on the surface of the hand roller, the photograph's surface tends to be damaged by such dust. As is clear from the above, the conventional photograph backing material and the conventional method of backing the photograph with the backing material suffer from many problems.

SUMMARY OF THE INVENTION

Consequently, it is an object of the present invention to a method of backing a photograph, and a backing material for backing the photograph, all of which is free from any of the above problems inherent in the prior art. In other words, it is an object of the present invention to a method of backing a photograph, and a backing material for backing the photograph, wherein: the backing material is resistant to variations in heat, temperature and in moisture; further, the backing material is large in bending strength, tearing strength and in resiliency; still further, the backing material is relatively thin in thickness and light in weight, is tough, and is under tension so as to be resistant to curling and warping deformation; a worker may cut the backing material using ordinary scissors,knives and like ordinary cutting tools; and, even an amateur or unskilled worker may easily treat the backing material in a mirror-finishing operation of a photograph.

It is another object of the present invention to provide an apparatus for bonding the backing material to the photograph both of which are described above, wherein: the apparatus enables any worker to easily and precisely perform a position alignment operation of the photograph with its backing material, and does not require any cumbersome operation such as the operation for releasing the trapped air and like cumbersome operations; and, the apparatus is capable of fine finishing the photograph in bonding the photograph to its corresponding backing material.

The above objects of the present invention are accomplished by providing:

A method of backing a photograph, characterized in that: disposed on a photograph bonding surface of a backing material are an immense number of deposits of an adhesive; and, the deposits assume dot-like shapes or linear shapes, and are provided at appropriate intervals.

Preferably: the deposits assume the dot-like shapes; each of the deposits has a surface area of 0.7 square millimeters; and, the number of the deposits is more than 200 pieces per square inch, preferably within a range of from 1300 to 1500 pieces.

Preferably: the deposits assume the linear shapes; the number of the linear shapes is within a range of from 30 to 50 lines per inch; and each of the lines has a line width which is within a range of from 0.4 to 0.7 millimeter.

Preferably: the backing material is similar to or resembles the photograph in material properties.

Preferably: the photograph bonding surface is dense with geometrical microscopic irregularities; and, the adhesive is applied onto top portions of convex portions of the geometrical microscopic irregularities.

Further, the above objects of the present invention are accomplished by providing:

A method of backing a photograph, characterized in that: a photograph bonding surface of a backing material is dense with geometrical microscopic irregularities which has its concave portions filled with an adhesive; and, the photograph is bonded to the photograph bonding surface of the backing material.

Preferably: the geometrical microscopic irregularities are constructed of microscopic through-holes or microscopic grooves.

Preferably: the geometrical microscopic irregularities are constructed of microscopic through-holes or microscopic grooves.

Still further, the above objects of the present invention are accomplished by providing:

A photograph backing material constructed of a plastics laminate in which plastics materials such as acrylic resin, vinyl chloride, polypropylene, polyester, polyethylene and the like are mixed with particles or powders of calcium carbonate, sawdust, carbon, charcoal and the like and molded.

The above objects of the present invention are accomplished by providing:

A photograph backing material constructed of a plastics laminate in which: impregnated with a plastic resin is paper or cloth; or, a plastic resin is filled with fibers such as glass, carbon and the like, the fibers forming a linear construction, a network and the like.

Further, the above objects of the present invention are accomplished by providing:

In a photograph backing material of a laminate type constructed of a substrate sandwiched between an upper and a lower surface member, the improvement wherein:

each of the upper and the lower surface member is formed by cutting an elongated material;

an upper surface of each of the upper and the lower surface member is disposed in the same side as that of a front or a rear surface of the elongated material; and when the elongated material is cut to produce the upper surface member, a front end portion of the upper surface member is disposed in overlapping relation with a corresponding front end portion of the lower surface member when the elongated material is cutto produce the lower surface member, in which relation the upper and the lower surface member are bonded together.

Still further, the above objects of the present invention are accomplished by providing:

In a photograph backing material of a laminate type constructed of a substrate sandwiched between surface members, the improvement wherein:

geometrical irregularities are provided in a bonding surface of at least one of the substrate and the surface members.

The above objects of the present invention are accomplished by providing:

In a photograph backing material of a laminate type constructed of a substrate sandwiched between surface members, the improvement wherein:

provided in both of the surface members are either geometrical irregularities, microscopic holes, or microscopic grooves.

The above objects of the present invention are accomplished by providing:

In a photograph backing material of a laminate type constructed of a substrate sandwiched between surface members, the improvement wherein:

the substrate is constructed of a honeycomb structure made of either paper, metal, plastics or the like.

Preferably, the surface members are made of material which is permeable to ultraviolet light.

Further, the above objects of the present invention are accomplished by providing:

A photograph backing material comprising:

a substrate which is small in resistance to high temperature;

plastics surface members disposed in opposite sides of the substrate, wherein the plastics surface members are larger in resistance to high temperature than the substrate, also larger in rigidity than the substrate, and laminated to the substrate to form the photograph backing material. Still further, the above objects of the present invention are accomplished by providing:

A photograph backing material characterized in that:

a substrate has its opposite sides bonded to surface members including a front and a rear surface member; and the front surface member is different in hardness or thickness from the rear surface member.

The above objects of the present invention are accomplished by providing:

A photograph backing material characterized in that:

a substrate has its opposite sides bonded to surface members; and material excellent in heat conductivity such as aluminum, copper and the like is vapor deposited or bonded to either a front side, rear side or central portion of one of the surface members, to which one a photograph is bonded.

Preferably: the photograph backing material is wrapped around a core to form a roll for transportation; and, in use, the photograph backing material thus rolled is unwound by a length required, and cut to provide a necessary-length piece of the photograph backing material.

Further, preferably: the photograph backing material has its photograph bonding surface covered with a peelable sheet of graph paper.

Still further, preferably: the photograph backing material has one of its opposite sides be excellent in smoothness to enable either a direct printing process or a thermal transfer printing process to be applied to the one of said opposite sides.

The above objects of the present invention are accomplished by providing:

An apparatus for bonding a backing material to a photograph, comprising:

a receiving base portion;

a lid portion connected with the receiving base portion;

a suction sleeve portion disposed in a connection area between the receiving base and the lid portion;

wherein each of the receiving base portion and the lid portion is provided with an absorption plate, the absorption plate being provided with a ventilation space and a plurality of ventilation through-holes together with a pressure reduction means for the ventilation space;

wherein the absorption plates are brought into close contact with each other when the lid portion is closed.

Preferably, the ventilation space is maintained by using a leaf spring which supports the absorption plate.

Further, preferably the ventilation space is maintained by using either a corrugated plate or a honeycomb plate, wherein either the corrugated plate or the honeycomb plate supports the absorption plate.

The above objects of the present invention are accomplished by providing:

An apparatus for bonding a backing material to a photograph, comprising:

a receiving base portion;

a lid portion connected with the receiving base portion;

a suction sleeve portion disposed in a connection area between the receiving base and the lid portion;

a suction mechanism;

wherein each of the receiving base portion and the lid portion is formed by the steps of: covering a honeycomb plate with fibrous materials; and, hermetically covering both the honeycomb plate and the fibrous materials with a sheet, the sheet being provided with an air suction hose mounting mouthpiece through which the sheet communicates with the suction mechanism.

The present invention having the above construction enables any worker to easily and precisely align in position the photograph with its corresponding backing material and to be free from any cumbersome operation such as the trapped air releasing operation the like, which makes it possible for the worker to fine finish the photograph in its backing operation using the apparatus of the present invention.

BRIEF DESCRIPTION OF THE DRAWINGS

The above and other objects, advantages and features of the present invention will be more apparent from the following description taken in conjunction with the accompanying drawings in which.

DETAILED DESCRIPTION OF THE PREFERRED EMBODIMENTS

The best modes for carrying out the present invention will be described in detail using embodiments of the present invention with reference to the accompanying drawings.

FIRST EMBODIMENT

In a first embodiment of the present invention: disposed on a photograph bonding surface of a backing material 1 are an immense number of deposits of an adhesive 2. These deposits assume dot-like shapes, and are provided at appropriate intervals.

Figure 1:
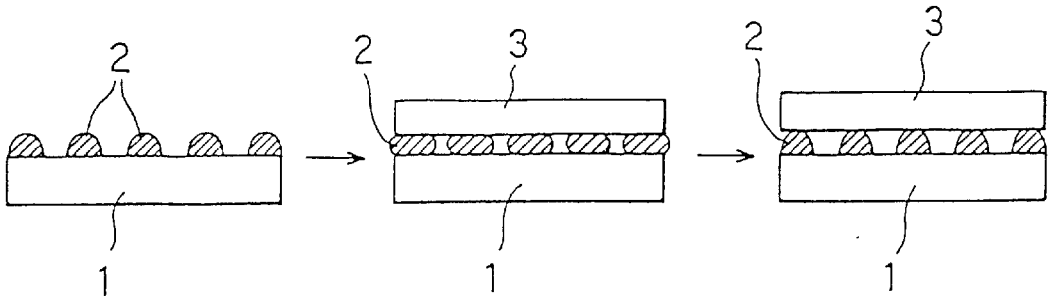
FIG. 1 is a view illustrating an embodiment of the method of the present invention.

More specifically, FIG. 1 shows an embodiment of a method of backing a photograph 3 with the backing material 1 the present invention, wherein: the immense number of the deposits of the adhesive 2 are disposed on a flat upper portion of the backing material 1, provided that the adhesive 2 is large in self-sustaining power (i.e., cohesive power), also relatively large in hardness, and has a sufficient resiliency to return to its initial shape even when pressed; and, the photograph 3 is lightly put on top portions of the deposits of the adhesive 2, so that there is no fear that the air is trapped between the backing material 1 and the photograph 3.

The adhesive 2 used in this embodiment is of, for example: synthetic rubber type, which is strengthened in cohesive power; EVA type; acrylic resin type; ethylene type; olefin type; or, the like. The type of the adhesive 2 used in this embodiment may vary so as to correspond to variations in photographs, posters and the like being bonded through the adhesive 2. In general, Application of the adhesive 2 to the backing material is carried out by a roll coater using a roll which is provided with an immense number of concave portions in its outer peripheral surface, wherein the adhesive 2 is filled in these concave portions of the roll.

Figure 2:
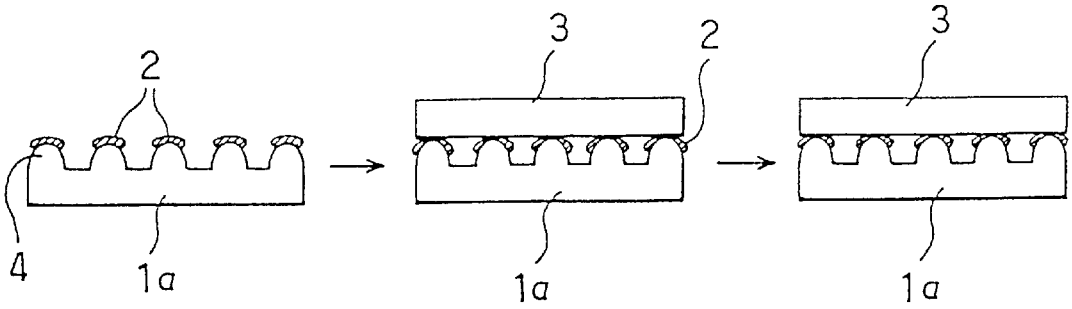
FIG. 2 is a view illustrating another embodiment of the method of the present invention.

FIG. 2 shows another embodiment of the method of the present invention, wherein: an immense number of geometrical irregularities are formed in a surface of the backing material la at suitable intervals or with no intervals; and, the adhesive 2 is applied to top portions of convex portions 4 of such geometrical irregularities. In this embodiment shown in FIG. 2, the adhesive 2 may be of the same type as that of the adhesive 2 used in the embodiment shown in FIG. 1. Further, it is also possible for the adhesive 2 of FIG. 2 to be smaller in resiliency than the adhesive of FIG. 1. In other words, when pressed through the photograph 3, the adhesive 2 of FIG. 2 is permitted to assume its flattened shape even after the pressure is removed from the photograph 3.

Figure 3:
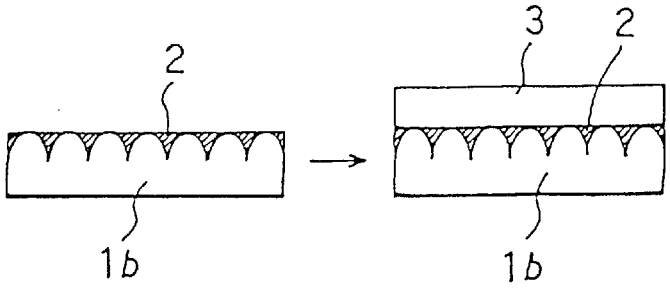
FIG. 3 is a view illustrating further another embodiment of the method of the present invention.

FIG. 3 shows further another embodiment of the method of the present invention, wherein: an immense number of geometrical irregularities are closely formed in a surface of the backing material 1*b*; and, the adhesive 2 is applied to the surface of the backing material 1*b* so as to fill any concave portions of these geometrical irregularities. Instead of forming these geometrical irregularities in the surface of the backing material 1*b*, it is also possible to form an immense number of geometrical irregularities in a rear surface of the photograph 3. It is also possible to form the geometrical irregularities in both the backing material 1*b* and the photograph 3. As will be described later, when this method of the present invention is applied in producing a laminated sheet of paper by bonding, it is possible to reduce the laminated sheet constant in thickness as a whole.

In forming the above-mentioned dot-like deposits of the adhesive 2 shown in FIG. 1: preferably, each of the deposits has a surface area of less than 0.7 square millimeters; and, the number of the deposits is more than 200 pieces per square inch, preferably, within a range of from 1300 to 1500 pieces. When the deposits of the adhesive 2 assumes linear shapes, preferably: the number of the liner-shaped deposits is within a range of from 30 to 50 lines per square inch; and, the width of each of the liner-shaped deposits is within a range of from 0.4 to 0.7 millimeters.

In general, the backing material 1 is constructed of a vinyl chloride sheet or an acrylic resin sheet, because these sheets are large in water absorption and lower in thermal deformation than PET and polyethylene, and therefore susceptible to the influence of heat. Due to this, these sheet vary in size even at room temperature.

When the backing material 1 is made of vinyl chloride or acrylic resin: the dot-like deposits of the adhesive 2 are disposed on the backing material 1, as shown in FIG. 1; and, then, the photograph 3 having its substrate made of PET or polyethylene is bonded to the backing material 1 through such dot-like deposits of the adhesive 2, so that the adhesive 2 adheres to both the backing material 1 and the photograph 3. Under such circumstances, as described above, since the backing material 1 varies in size even at room temperature, the deposits of the adhesive 2 is forcibly displaced. When the backing material 1 is made of material larger in thermal expansion coefficient than that of the substrate of the photograph 3, the backing material 1 tends to expand and contract relative to the photograph 3 which substantially remains unchanged in size when the ambient temperature remains at around a normal value. Due to the presence of such relative motion of the backing material 1, the deposits of the adhesive 2 are closely packed when the backing material 1 contracts relative to the photograph 3. On the other hand, when the backing material 1 expands relative to the photograph 3, the deposits of the adhesive 2 are subjected to tension. As a result, the geometrical irregularities are formed in the surface of the photograph 3. When the ambient temperature further increases, the backing material 1 itself loses its surface smoothness and distorted, which enhances further formation of the geometrical irregularities in the surface of the photograph 3.

Due to this, preferably, the backing material 1 is made of the same material as that of the substrate of the photograph 3, or made of material which is equal in thermal properties to that of the substrate of the photograph 3. In other words, preferably, the backing material 1 is made of PET, polyethylene, polypropylene or the like. This prevents displacement of the deposits of the adhesive 2 even when the ambient temperature and moisture considerably vary, because the backing material 1 may expand and contract in substantially the same manner as that of the photograph 3.

Further, the geometrical irregularities may be replaced with microscopic through-holes or grooves closely formed. Still further, the backing material 1 may have its photograph bonding surface covered with a peelable sheet of graph paper, which facilitates a positioning operation of the photograph 3 relative to the backing material 1.

SECOND EMBODIMENT

In a second embodiment of the present invention, the photograph backing material is constructed of a plastics laminate. In this laminate: plastics materials such as acrylic resin, vinyl chloride, polypropylene, polyester, polyethylene and the like are mixed with particles or powders of calcium carbonate, sawdust, carbon, charcoal and the like and molded. Alternatively, the photograph backing material is constructed of a plastics laminate in which: impregnated with a plastic resin is paper or cloth; or, a plastic resin is filled with fibers such as glass, carbon and the like, the fibers forming a linear construction, a network and the like.

Figure 4A:
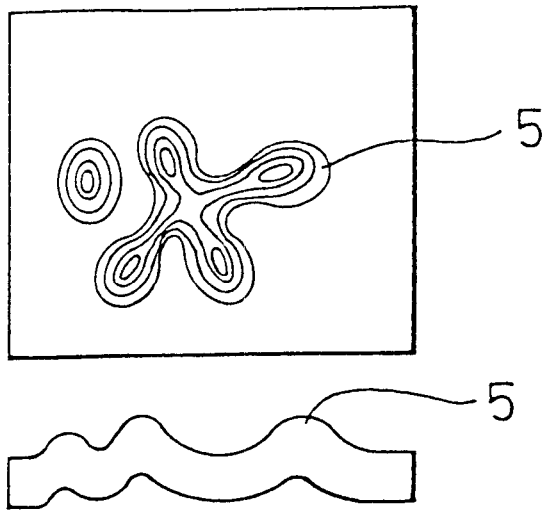
FIGS. 4(A) and 4(B) are views illustrating still further another embodiment of the method of the present invention.
Figure 4B:
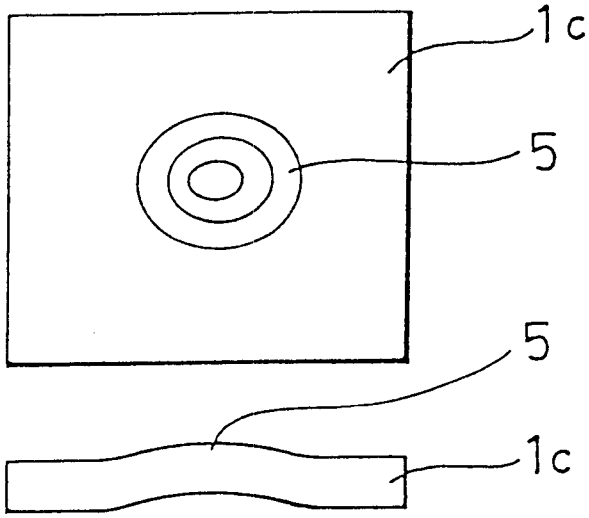

These laminates described above are small in thermal distortion. Further, it is possible to make the contour of such thermal distortion coherent. This is shown in FIGS. 4(A) and 4(B). More specifically, FIG. 4(A) shows the laminate of the backing material 1 in which laminate: only the plastics materials such as acrylic resin, vinyl chloride, polypropylene, polyester, polyethylene and the like are mixed with particles or powders of calcium carbonate, sawdust, carbon, charcoal and the like and molded. On the other hand, FIG. 4(B) shows the laminate of the backing material 1, in which laminate: impregnated with a plastic resin is paper or cloth; or, a plastic resin is filled with fibers such as glass, carbon and the like, the fibers forming a linear construction, a network and the like. The above-mentioned "paper", "cloth", and "fibers" will be referred to as "impurities".

As shown in FIGS. 4(A) and 4(B), in the case of a single plastics material, heat applied from above causes large thermal deformation. Further, a convex portion 5 of such thermal deformation varies in contour. Due to this, the single plastics material is not suitable for the photograph backing material. In contrast with this, in case that the "impurities" are mixed, the convex portion 5 of the thermal deformation assumes a small circular shape formed in a central area of the deformation, as shown in FIG. 4(B). Consequently, material mixed with the "impurities" is a favorable material for the photograph backing material. The reason why such a difference in effect is produced between the material of FIG. 4(A) and that of FIG. 4(B) is that: the "impurities" mixed according to the present invention serve as cross linkers to prove cross linking effect.

In case that the backing material 1*c* of the present invention is used, when a surface of this backing material 1*c* is smooth (i.e., mirror finished), it is possible to use the backing material 1*c* without any further surface processing. In contrast with this, when the surface of the backing material 1*c* has small geometrical irregularities, it is necessary to smooth this surface with the use of a resin material. This resin material is welded to the surface of the backing material 1*c* to smooth the surface of the backing material 1*c* . Consequently, it is necessary that the resin material; is of the same type as that of the surface of the backing material 1*c* ; or, is of a type different from the type of the backing material 1*c* but has the same melting temperature as that of the surface of the backing material 1*c* . Further, in case that the backing material 1*c* is of a type rejecting an adhesive, it is preferable that the backing material 1*c* is previously subjected to a suitable surface treatment, for example such as a primer treatment, a corona discharge treatment, a plasma treatment, a sand blasting treatment, and the like before the adhesive is applied to the surface of the backing material 1*c*.

THIRD EMBODIMENT

In a third embodiment of the present invention: the photograph backing material id of a laminate type is constructed of a substrate which is sandwiched between an upper and a lower surface member; each of the upper and the lower surface member is formed by cutting an elongated material; an upper surface of each of the upper and the lower surface member is disposed in the same side as that of a front or a rear surface of the elongated material; and, when the elongated material is cut to produce the upper surface member, a front end portion of the upper surface member is disposed in overlapping relation with a corresponding front end portion of the lower surface member when the elongated material is cut to produce the lower surface member, in which relation the upper and the lower surface member are bonded together.

Figure 5:
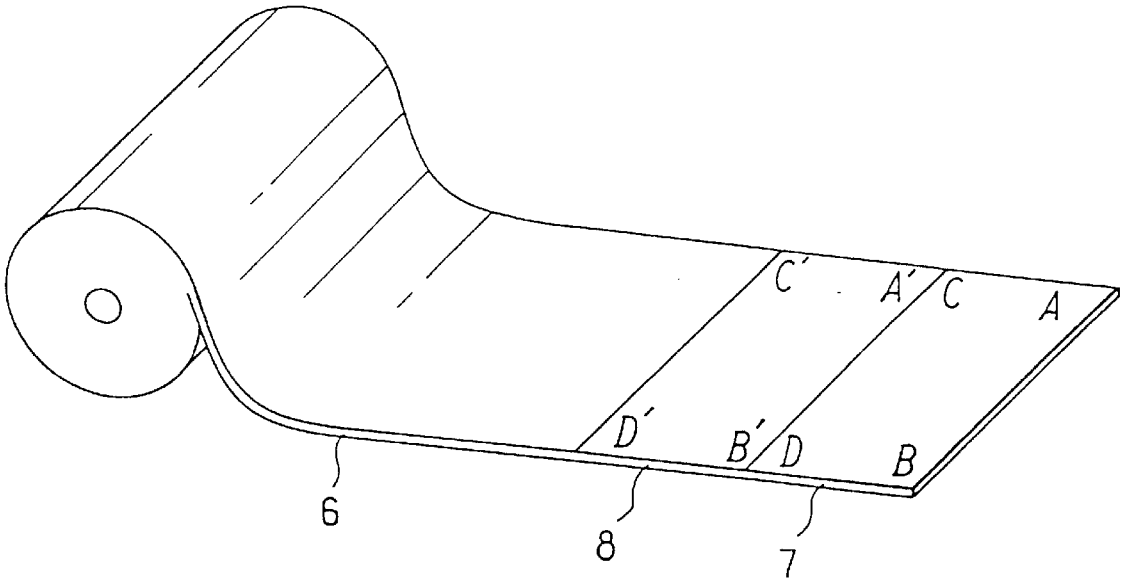
FIG. 5 is a perspective view illustrating another embodiment of the method of the present invention.
Figure 6:
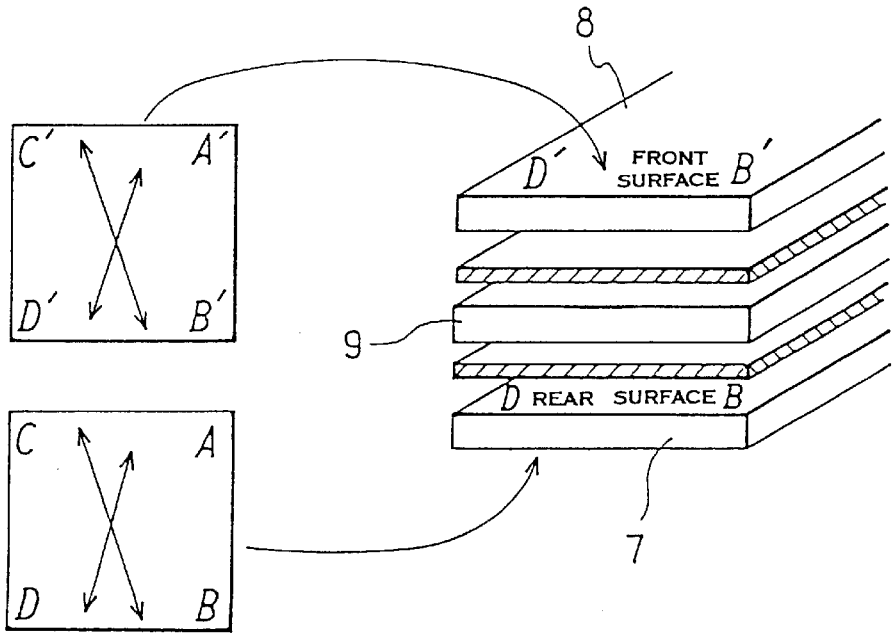
FIG. 6 is a view illustrating procedures for performing the method of the present invention shown in FIG. 5.

As shown in FIGS. 5 and 6, the backing material id of the third embodiment is formed in a manner such that: a roll of plastics sheet (i.e., starting material) 6 is unwound by a length required, and cut off to provide a necessary-length surface member (7, 8) each cutting operation, so that a pair of the surface members 7, 8 are produced; and, a substrate 9 which is made of a resin different from that of these surface members 7, 8 is sandwiched between these surface members 7,. 8 so that the backing material id is formed. In this case, in a cutting operation, the surface members 7, 8 have their front end sides A-B, A'-B' vertically aligned with each other in position. At this time, there is no need the surface members 7, 8 to be turned over relative to each other. Namely, an angle "A" is vertically aligned with an angle "A'".

The reason why this is so is that: orientation in texture (hereinafter referred to as the texture orientation) of the starting material 6 is important; and, it is necessary to vertically align the surface members 7, 8 with each other in texture orientation in order to prevent the surface members 7, 8 from curling. In other words, in producing the starting material 6 by a drawing operation, a high-temperature blank of the starting material 6 is gradually cooled as it is taken up through a tensioner. At this time, the texture orientation is produced in the starting material 6 due to variations in tensile strength of the starting material in direction (shown by the double arrows of FIG. 6). More specifically, as shown in FIG. 6, in general, the tensile strength of the starting material 6 is not even but varies in direction, which produces the texture orientation slightly inclined in either side relative to a longitudinal direction of the starting material 6.

Figure 7:
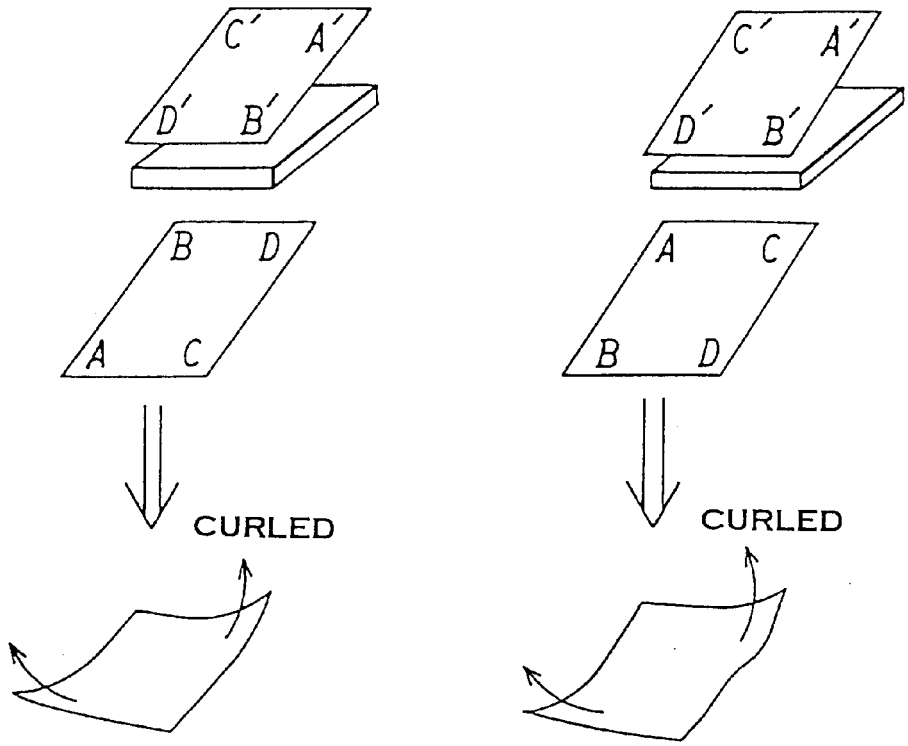
FIG. 7 is a perspective view illustrating disadvantages encountered in performing a method other than the method of the present invention shown in FIG. 5.

Consequently, in the present invention, the surface members 7, 8 are verticaly aligned with each other in position in a manner such that the surface members 7, 8 are the same in texture orientation. This is the test results obtained through various experiments performed by the present inventor. Namely, any of the conventional starting materials has its corner portions curled, as shown in FIG. 7.

It is preferable to use a sheet of multi-layered synthetic paper as the substrate 9 which is sandwiched between these surface members 7, 8, provided that the multi-layered synthetic paper is provided with immense number of microscopic holes in its interior.

Figure 8A:
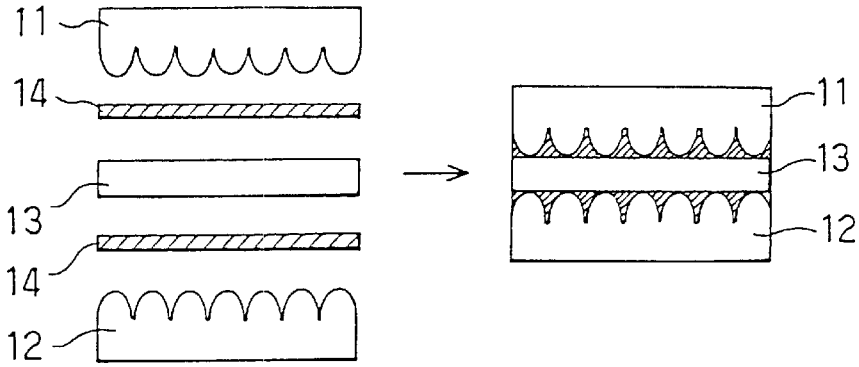
FIGS. 8(A)to 8(C) are views illustrating the remaining embodiments of the method of the present invention.
Figure 8B:
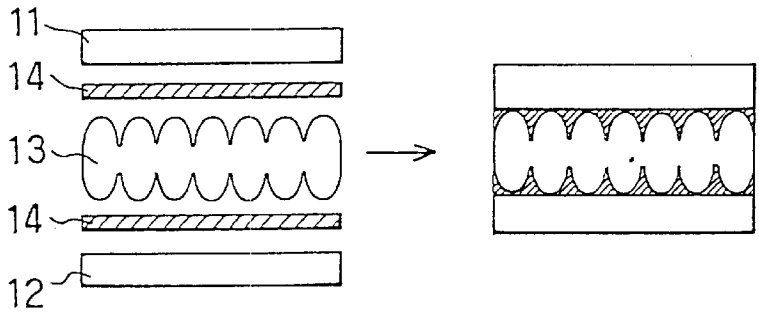

Examples shown in FIGS. 8(A) to 8(B) show modifications of the laminate-type backing material, wherein geometrical irregularities are formed in at least one of the adhesive surfaces of: the substrate 11; and, the surface members. 12, 13. More specifically, in the backing material shown in FIG. 8(A), the geometrical irregularities are formed in the adhesive surface of each of the surface members 12, 13. In the backing material shown in FIG. 8(B), the geometrical irregularities are formed in opposite adhesive surfaces of the substrate 11. Further, in the backing material shown in FIG. 8(C), the geometrical irregularities are formed in: the adhesive surface of each of the surface members 12, 13; and, the opposite adhesive surfaces of the substrate 11. the geometrical irregularities are formed by an embossing operation, a sand blasting operation and the like. He adhesive layer 14 is interposed between adjacent ones of the adhesive surfaces. The adhesive layer 14 may be replaced with an adhesive sheet in application. It is also possible to apply the adhesive layer 14 using a coater and the like. After the substrate 11 is sandwiched between the surface members 12, 13 to produce a preform of the backing material, such a preform is evenly pressed over its entire surface to force the adhesive to enter clearances of the geometrical irregularities, so that the geometrical irregularities have their convex portions brought into contact with the substrate 11 in the case of the backing material shown in FIG. 8(A) as well as the other cases, which makes it possible to produce the backing material having a smooth surface and being constant in thickness.

In another example of the laminate-type backing material: the substrate is small in resistance to high temperature; and, the surface members are made of plastics, and disposed in opposite sides of the substrate, wherein the surface members are larger in resistance to high temperature than the substrate, also larger in rigidity than the substrate, and laminated to the substrate to form the photograph backing material.

In further another example of the laminate-type backing material: the substrate has its opposite sides bonded to the surface members; and, material excellent in heat conductivity such as aluminum, copper and the like is vapor deposited or bonded to either a front side, rear side or central portion of one of the surface members, to which one the photograph is bonded. When this backing material is subjected to heat, heat can be promptly and evenly transferred through the entire surface of the backing material, which realizes even variations in temperature to control the backing material in its thermal expansion and contraction.

When the photograph is bonded to the above laminate-type backing material, the adhesive is applied as a suitable form such as the dot-like deposits of the adhesive and the like. If necessary, the geometrical irregularities are formed in the adhesive surface of each of the backing material and/or the photograph. Further, the geometrical irregularities in the laminate-type backing material may be replaced with microscopic holes or microscopic grooves.

As described above, in the present invention, the backing material is resistant to variations in heat, temperature and in moisture. Further, the backing material is large in bending strength, tearing strength and in resiliency. Still further, the backing material is relatively thin in thickness and light in weight, is tough, and is under tension so as to be resistant to curling and warping deformation. A worker may cut the backing material using ordinary scissors, knives and like ordinary cutting tools. Even an amateur or unskilled worker may easily treat the backing material in a mirror-finishing operation of the photograph.

Subsequent to the above, now, with reference to FIGS. 9 to 16, an apparatus of the present invention for bonding the backing material to the photograph will be described.

Figure 9:
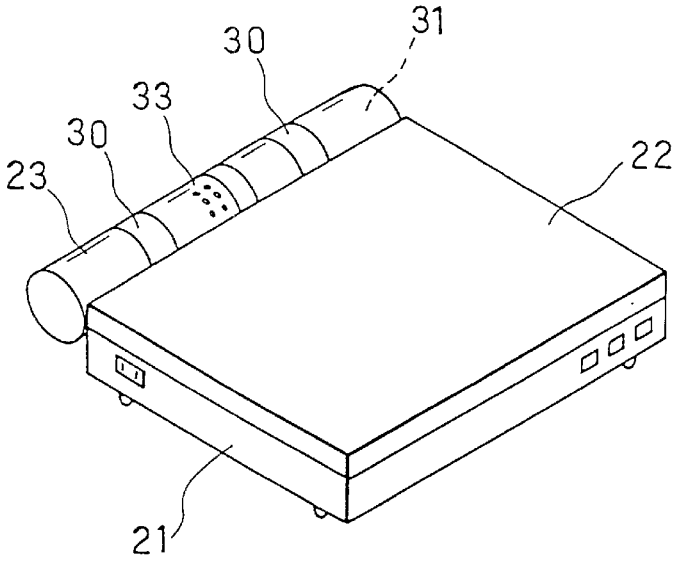
FIG. 9 is a perspective view of an embodiment of the apparatus of the present invention in its closed condition.
Figure 10:
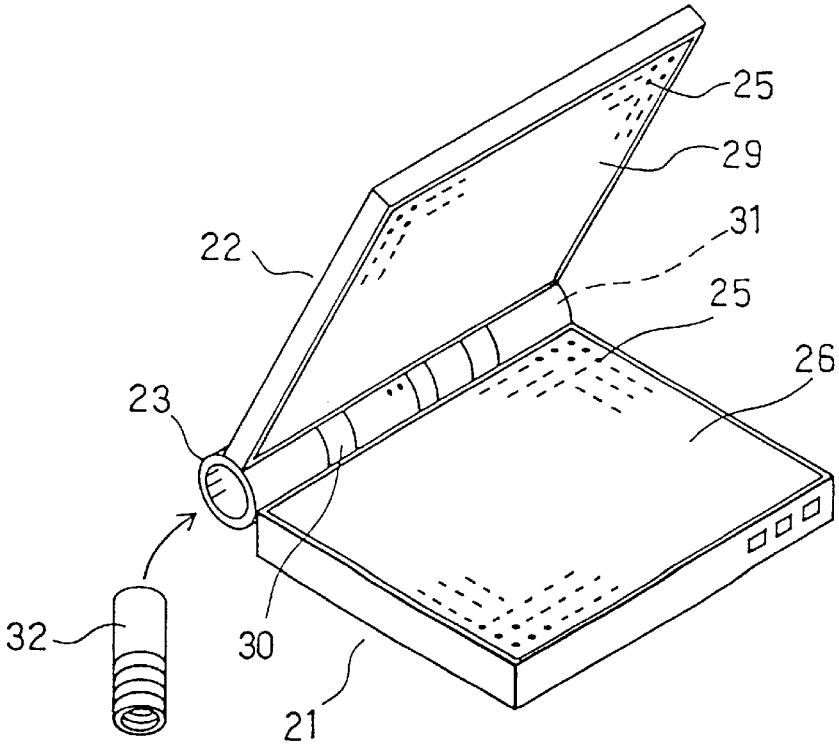
FIG. 10 is a perspective view of the apparatus of the present invention in its open condition.
Figure 11:
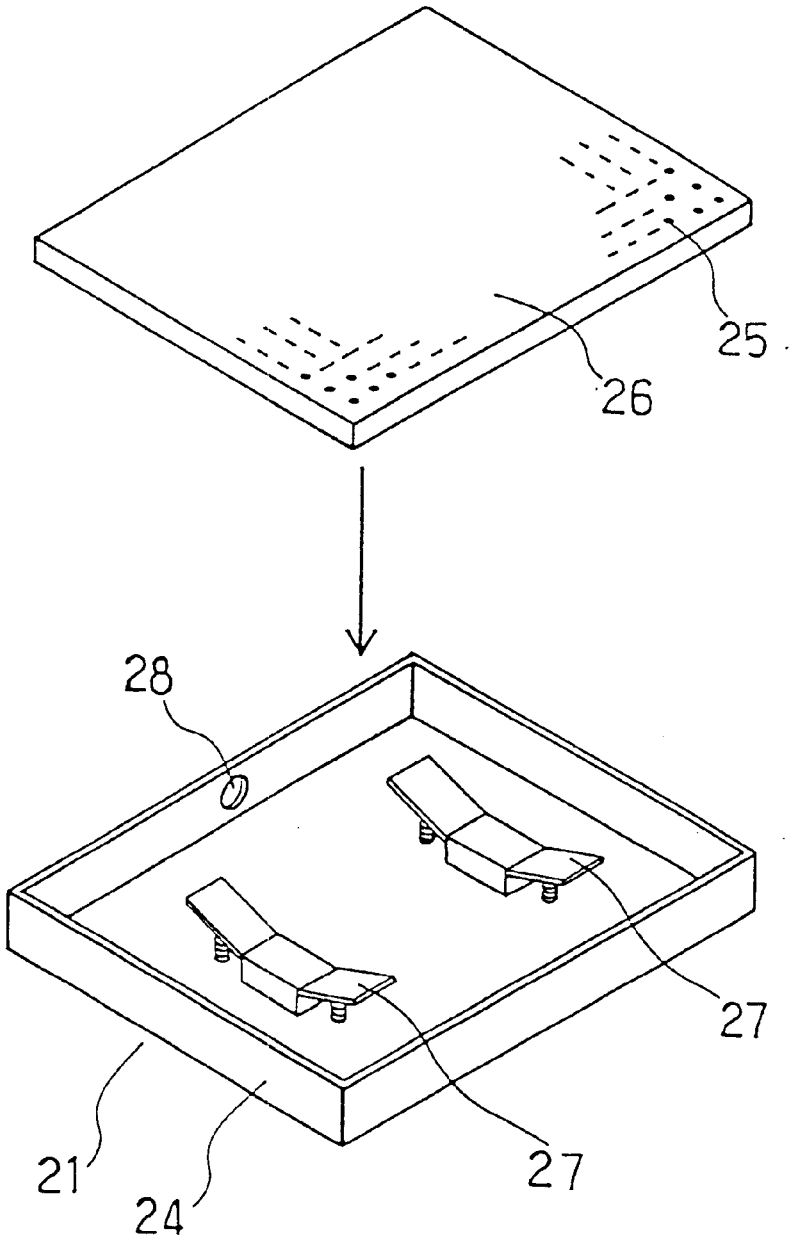
FIG. 11 is an exploded perspective view of the receiving base portion of the apparatus of the present invention.

FIG. 9 is a perspective view of an embodiment of the apparatus of the present invention in its closed condition. FIG. 10 is a perspective view of the apparatus of the present invention in its open condition.

The apparatus of the present invention for bonding the backing material to the photograph, comprises: a receiving base portion 21; a lid portion 22 connected with the receiving base portion 21; a suction sleeve portion 23 disposed in a connection area between the receiving base portion 21 and the lid portion 22.

The receiving base portion 21 and the lid portion 22 are provided with absorption plate 26 and 29,respectively. Each of the absorption plates 26, 29 is provided with a ventilation space and a plurality of ventilation through-holes 25 together with a pressure reduction means for the ventilation space 26. The receiving base portion 21 has a box-like body 24. Further, the absorption plates 26 are brought into close contact with each other when the lid portion 22 is closed. As a means for maintaining the above ventilation space, one or more of leaf springs 27 are preferably used to resiliently push up the absorption plates 26, 29.

Figure 12:
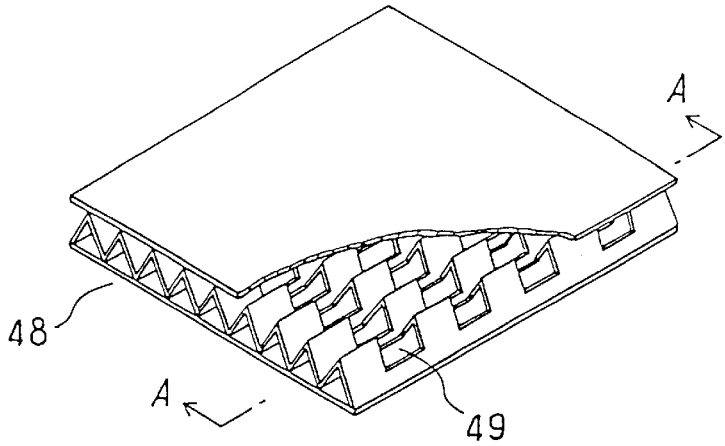
FIG. 12 is a partially broken perspective view illustrating a method for supporting the absorption plate used in another embodiment of the apparatus of the present invention.
Figure 13:
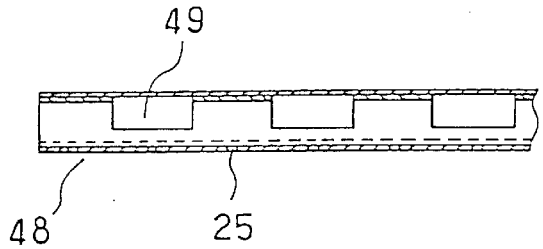
FIG. 13 is a partially enlarged cross-sectional view, taken along the line A—A of FIG. 12.

There are some other means for maintaining the ventilation space. For example, it is possible to replace the leaf spring 27 with: either a corrugated plate 48 constructed of thick paper; or, a honeycomb plate, as shown in FIGS. 12 and 13.

Figure 14:
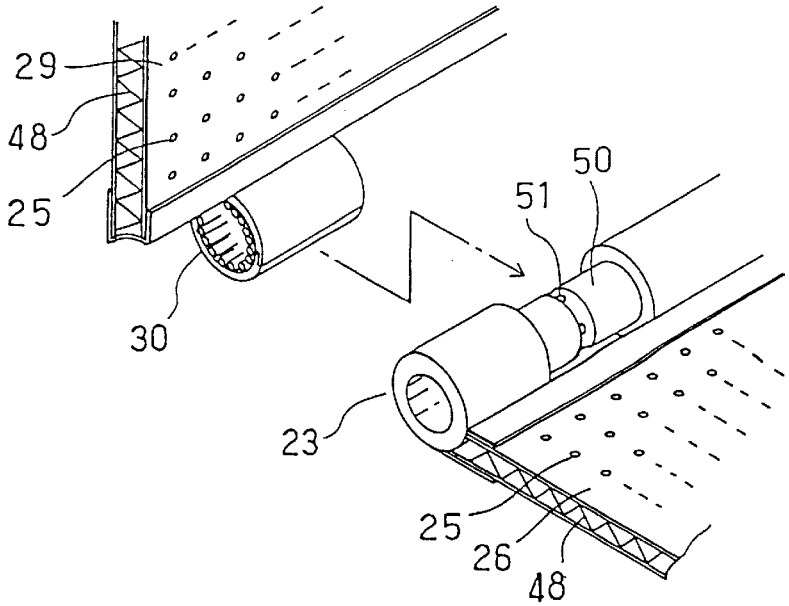
FIG. 14 is a perspective view illustrating in construction the suction sleeve portion of the apparatus of the present invention.
Figure 15:
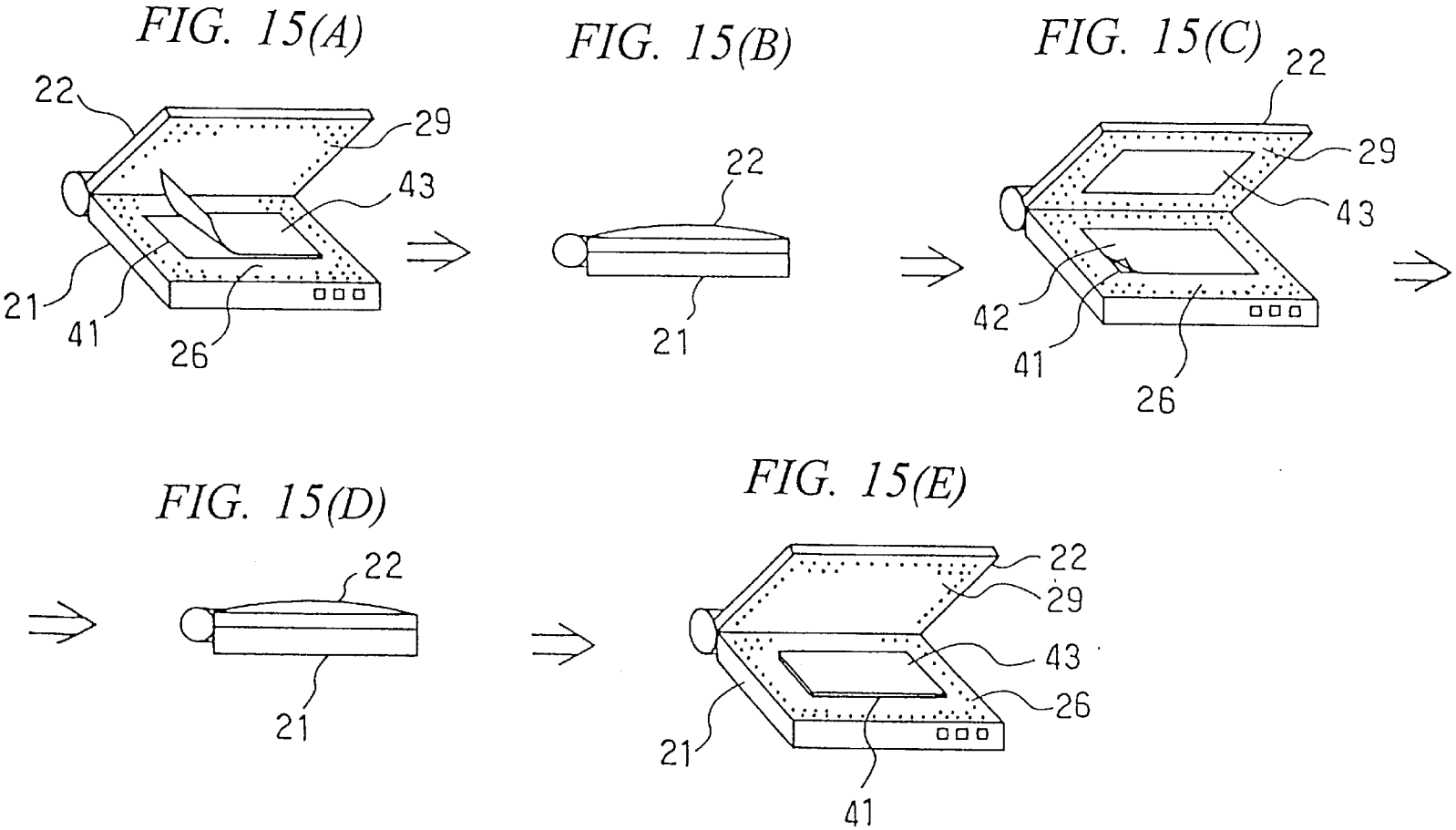
FIGS. 15(A) to 15(E) are views illustrating procedures for using the apparatus of the present invention.

In the latter case, a part of the corrugated plate 48 is cut off to provide an air passage 49 therein. Further, the box-like body 24 is provided with one or more of air bleeder hole 28 which communicates with the suction sleeve portion 23. This suction sleeve portion 23 also serves as a hinge means, and is fixed to either the receiving base portion 21 or the lid portion 22 (in the embodiment shown in the drawings, the suction sleeve portion 23 is fixed to the receiving base portion 21). The other portion 21 or 22, to which the suction sleeve portion 23 is not fixed, is fixed to a support sleeve 30 which is slidably mounted on the suction sleeve portion 23 so as to surround the same. In other words, as shown in FIG. 14, the support sleeve 30 is slidably mounted on a small-diameter. portion 50 of the suction sleeve portion 23. This small-diameter portion 50 is provided with an air passage 51. This air passage 51 communicates with the remaining portion of the suction sleeve portion 23. Further, another air passage (not shown) is formed in a connection portion of the support sleeve 30, through which connection portion the support sleeve 30 is connected with the lid portion 22, so that the interior portion of the suction sleeve portion 23 is communicated with the interior portion of the lid portion 22.

As shown in FIG. 10, a vacuum pump 31 is incorporated in an end portion of the suction sleeve portion 23. it is also possible to connect the suction sleeve portion 23 with a vacuum hose 32. The vacuum hose 32 may be connected with a suitable vacuum pump such as a domestic vacuum cleaner the like. If necessary, a suction control hole 33 may be formed in the suction sleeve portion 23. This suction control hole 33 functions to prevent the photograph from being damaged by an excessive suction force.

The apparatus of the present invention operates in a manner shown in FIGS. 15(A) to 15(E). More specifically, in use, as shown in FIG. 15(A): the lid portion 22 is first opened; the backing material 41 is put on the absorption plate 26 of the receiving base portion 21 in a condition in which the backing material 41 has its peelable sheet 42 directed upward; and, the photograph 43 is put on the peelable sheet 42 so as to be vertically aligned with the same in position. After that, as shown in FIG. 15(B): the lid portion 22 is closed; and, a power switch of the vacuum pump 31 is turned on to start a suction operation of the apparatus. Then, the lid portion 22 is opened in a condition in which the vacuum pump 31 remains energized. As a results, as shown in FIG. 15(C), the photograph 43 and the backing material 41 are separated from each other, because the photograph 43 and the backing material 41 are held by the absorption plate 29 and 26, respectively, under the effect of suction.

Under such circumstances, as shown in FIG. 15(C), the peelable sheet 42 is separated from the backing material 41. After that, the lid portion 22 is again closed, as shown in FIG. 15(D). At this time, since both the photograph 43 and the backing material 41 are held in their predetermined positions under suction, they are neatly bonded together without any misalignment in position. After that, the switch is turned off to stop the suction operation, which makes it possible for the worker to open the lid portion 22 and take out the completed product from the apparatus, as shown in FIG. 15(E).

In the embodiments shown here, when the lid portion 22 is closed in bonding operation, the absorption plates 26, 29 are brought into close contact with each other. However, since these absorption plates 26, 29 are resiliently supported by the individual leaf springs 27, it is possible for the photograph 43 to be evenly brought into contact with the backing material 41 at a moderate contact pressure over the entire surface of the photograph. As a result, it is possible to neatly and evenly bond the backing material 41 to the rear surface of the photograph 43.

Figure 8C:
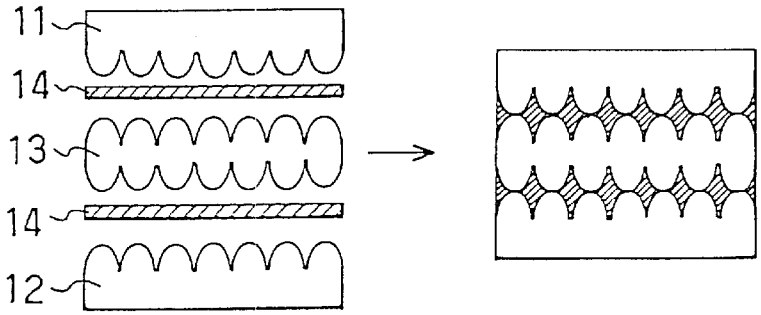
Figure 16:
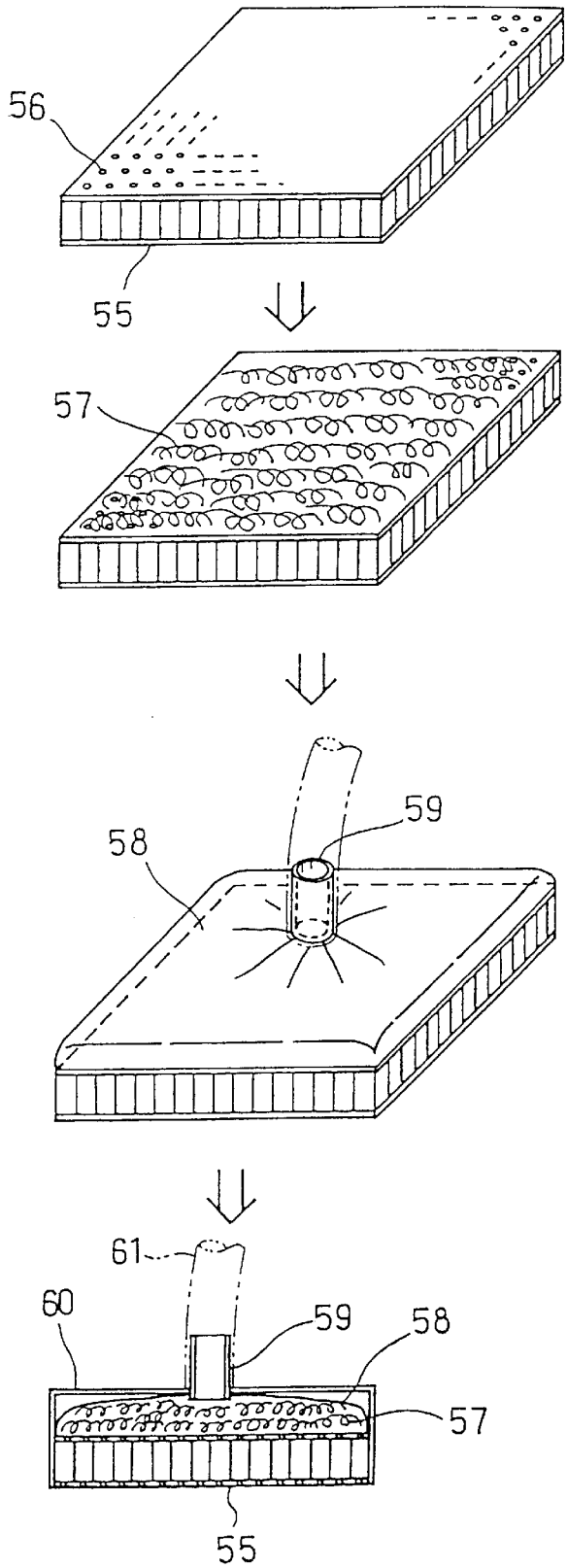
FIG. 16 is a perspective view illustrating further another embodiment of the apparatus of the present invention.
Figure 17A:
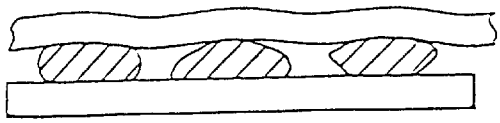
FIG. 17(A) RELATED ART
FIGS. 17(A) to 17(B) are views illustrating the disadvantages inherent in the conventional backing method.
Figure 17B:
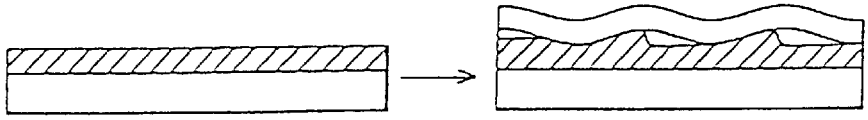
FIG. 17(B) RELATED ART
Figure 18A:
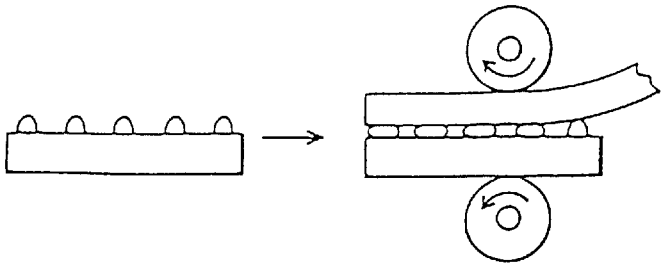
FIG. 18(A) RELATED ART
FIGS. 18(A) to 18(B) are views illustrating the conventional backing method.
Figure 18B:
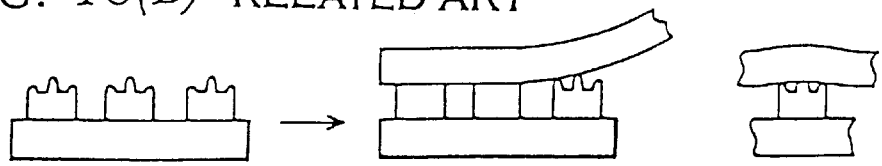
FIG. 18(B) RELATED ART

FIGS. 8(A) to 8(C) show another construction of the suction mechanism used in each of the receiving base portion 21 and the lid portion 22 of the apparatus of the present invention, wherein: each of the receiving base portion 21 and the lid portion 22 is formed by the steps of: covering a honeycomb plate 55 with fibrous materials 57 such as carbon fibers, glass fibers and the like, as shown in an upper middle part of FIG. 16, wherein the honeycomb plate 55 is made of metal or plastics and provided with an immense number of vertical through-holes 56, as shown in an upper part of FIG. 16; and, hermetically covering both the honeycomb plate 55 and the fibrous materials 57 with a sheet or inner cover 58 made of vinyl and the like, the inner cover 58 being provided with an air suction hose mounting mouthpiece 59 through which the interior of the inner cover 58 communicates with a suitable suction mechanism.

Further, the honeycomb plate 55 is provided with a casing 60 which is made of metal, plastics and the like. As shown in a lower part of FIG. 16, the suction hose mounting mouthpiece 59 extends upward from an opening of the casing 60, and hermetically connected with a suction hose 61 which is shown in phantom lines. In the apparatus of the present invention having this construction, the honeycomb plate 55 serves as each of the suction plates 26, 29 of the foregoing embodiment.

Finally, the present application claims the Convention Priority based on Japanese Patent Application No. Hei 11-262169 filed on Sep. 16, 1999, which is herein incorporated by reference.

What is claimed is:

1. A method for bonding a backing material to a photograph, comprising:

providing a photograph backing material;

applying dot-like shaped deposits of an adhesive to a bonding surface of the photograph backing material, wherein a density of said deposits is at least 200 deposits per square inch; and adhesively coupling, via the deposits, a bonding surface of the photograph to the bonding surface of the photograph backing material.

2. The method of claim 1, wherein each of said deposits has a surface area of 0.7 square millimeters.

3. The method of claim 1, wherein said backing material is similar to or resembles about the same as said photograph in material properties.

4. The method of claim 1, wherein the bonding surface of the photograph backing material comprises a plurality of geometrical microscopic irregularities, and wherein said adhesive is applied onto portions of said geometrical microscopic irregularities.

5. A method for bonding a backing material to a photograph, comprising:

providing a photograph, and providing a photograph backing material that comprises a plurality of geometrical microscopic irregularities that are constructed of microscopic through-holes filled with an adhesive, wherein a bottom side of the photograph is adhesively coupled to a bonding surface of the photograph backing material.

6. The method of claim 4, wherein said geometrical microscopic irregularities are constructed of microscopic through-holes or microscopic grooves.

7. A method for bonding a backing material to a photograph comprising:

providing a photograph backing material;

applying linear shaped deposits of an adhesive to a bonding surface of the photograph backing material, wherein a density of said deposits is in a range of 30–50 lines per inch; and adhesively coupling a bonding surface of the photograph to the bonding surface of the photograph backing material.

8. The method of claim 7 wherein each of said lines has a line width which is within a range of 0.4 to 0.7 millimeters.

9. The method of claim 7, wherein said backing material is about the same as similar to or resembles said photograph in material properties.

10. The method of claim 7, wherein the bonding surface of the photograph backing material comprises a plurality of geometrical microscopic irregularities, and wherein the adhesive is applied onto top portions of convex portions of said geometrical microscopic irregularities.

* * * * *

UNITED STATES PATENT AND TRADEMARK OFFICE

CERTIFICATE OF CORRECTION

PATENT NO. : 6,444,413 B1
DATED : September 3, 2002
INVENTOR(S) : Uto et al.

It is certified that error appears in the above-identified patent and that said Letters Patent is hereby corrected as shown below:

Column 10,
Lines 36, 50 and 58, delete “id” and insert -- 1d --

Signed and Sealed this

Eighteenth Day of March, 2003

JAMES E. ROGAN
*Director of the United States Patent and Trademark Office*